US007434439B2

(12) United States Patent
Zurecki

(10) Patent No.: US 7,434,439 B2
(45) Date of Patent: Oct. 14, 2008

(54) CRYOFLUID ASSISTED FORMING METHOD

(75) Inventor: Zbigniew Zurecki, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 11/250,346

(22) Filed: Oct. 14, 2005

(65) Prior Publication Data

US 2007/0084263 A1 Apr. 19, 2007

(51) Int. Cl.
*B21D 37/16* (2006.01)

(52) U.S. Cl. ..... 72/342.3; 72/69; 72/128; 72/201

(58) Field of Classification Search ..... 72/41–45, 72/201, 236, 342.1, 342.2, 342.3, 364, 39, 72/38, 69, 128, 200, 202, 342.7; 83/169, 83/171; 451/53, 449, 450; 82/50; 62/62, 62/64

See application file for complete search history.

(56) References Cited

U.S. PATENT DOCUMENTS

| | | | | |
|---|---|---|---|---|
| 2,635,399 | A | 4/1953 | West, Jr. | |
| 2,641,047 | A | 6/1953 | Jackman et al. | |
| 3,077,802 | A | 2/1963 | Philip | |
| 3,433,028 | A | 3/1969 | Klee | |
| 3,571,877 | A | 3/1971 | Zerkle | |
| 3,650,337 | A * | 3/1972 | Andrews et al. | 175/17 |
| 3,696,627 | A | 10/1972 | Longsworth | |
| 3,751,780 | A | 8/1973 | Villalobos | |
| 3,889,520 | A | 6/1975 | Stoferle et al. | |
| 3,900,975 | A | 8/1975 | Lightstone et al. | |
| 3,971,114 | A | 7/1976 | Dudley | |
| 3,979,981 | A | 9/1976 | Lightstone et al. | |
| 4,083,220 | A | 4/1978 | Kobayashi et al. | |
| 4,296,610 | A | 10/1981 | Davis | |
| 4,336,689 | A | 6/1982 | Davis | |
| 4,404,827 | A * | 9/1983 | Van den Sype | 72/41 |
| 4,510,760 | A | 4/1985 | Wieland | |
| 4,547,470 | A | 10/1985 | Tanase et al. | |
| 4,666,665 | A * | 5/1987 | Hornsby et al. | 419/48 |
| 4,715,187 | A | 12/1987 | Stearns | |
| 4,716,738 | A | 1/1988 | Tatge et al. | |

(Continued)

FOREIGN PATENT DOCUMENTS

| | | |
|---|---|---|
| CN | 87102713 | 4/1988 |

(Continued)

OTHER PUBLICATIONS

Hong, Shane Y., et al., Micro-temperature Manipulation in Cryogenic Machining of Low Carbon Steel, Elsevier Journal of Materials Processing Technology 116 (2001) pp. 22-30.

(Continued)

*Primary Examiner*—Edward Tolan
(74) *Attorney, Agent, or Firm*—Ann B. Kiernan

(57) ABSTRACT

Method of forming a workpiece comprising (a) providing a tool and a workpiece, wherein the workpiece has an initial shape; (b) placing the workpiece and the tool in contact, applying force to the tool and/or the workpiece, and moving the tool and/or the workpiece to effect a change in the initial shape of the workpiece by forming; and (c) providing a jet of cryogenic fluid and impinging essentially all of the jet of cryogenic fluid on a surface of the tool.

15 Claims, 8 Drawing Sheets

U.S. PATENT DOCUMENTS

| | | | | |
|---|---|---|---|---|
| 4,788,842 | A * | 12/1988 | Kopp et al. | 72/45 |
| 4,829,859 | A | 5/1989 | Yankoff | |
| 4,829,869 | A | 5/1989 | Katada et al. | |
| 4,844,047 | A | 7/1989 | Brehm et al. | |
| 4,848,198 | A | 7/1989 | Royal et al. | |
| 5,025,547 | A | 6/1991 | Sheu et al. | |
| 5,103,701 | A | 4/1992 | Lundin et al. | |
| 5,123,250 | A | 6/1992 | Maric | |
| 5,237,894 | A | 8/1993 | Lindeke | |
| 5,265,505 | A | 11/1993 | Frechette | |
| 5,392,608 | A | 2/1995 | Lee | |
| 5,432,132 | A | 7/1995 | Dasgupta et al. | |
| 5,449,647 | A | 9/1995 | Brandt | |
| 5,477,691 | A | 12/1995 | White | |
| 5,509,335 | A | 4/1996 | Emerson et al. | |
| 5,592,863 | A | 1/1997 | Jaskowiak et al. | |
| 5,597,272 | A | 1/1997 | Moriguchi et al. | |
| 5,716,974 | A | 2/1998 | Camaggi et al. | |
| 5,738,281 | A | 4/1998 | Zurecki et al. | |
| 5,761,941 | A * | 6/1998 | Matsui et al. | 72/42 |
| 5,761,974 | A | 6/1998 | Wang et al. | |
| 5,762,381 | A | 6/1998 | Vogel et al. | |
| 5,799,553 | A | 9/1998 | Billatos | |
| 5,862,833 | A | 1/1999 | Perez | |
| 5,878,496 | A | 3/1999 | Liu et al. | |
| 5,901,623 | A | 5/1999 | Hong | |
| 6,010,283 | A | 1/2000 | Henrich et al. | |
| 6,017,172 | A | 1/2000 | Ukegawa et al. | |
| 6,053,669 | A | 4/2000 | Lagerberg | |
| 6,105,374 | A | 8/2000 | Kamody | |
| 6,145,322 | A | 11/2000 | Odashima | |
| 6,179,692 | B1 | 1/2001 | Hara | |
| 6,200,198 | B1 | 3/2001 | Ukai et al. | |
| 6,202,525 | B1 * | 3/2001 | Hendrickson et al. | 83/16 |
| 6,305,183 | B1 | 10/2001 | Mukai et al. | |
| 6,330,818 | B1 * | 12/2001 | Jain | 72/42 |
| 6,332,385 | B1 | 12/2001 | Kautto et al. | |
| 6,360,577 | B2 * | 3/2002 | Austin | 72/402 |
| 6,454,877 | B1 | 9/2002 | Kumar et al. | |
| 6,513,336 | B2 | 2/2003 | Zureck et al. | |
| 6,564,682 | B1 | 5/2003 | Zurecki et al. | |
| 6,622,570 | B1 | 9/2003 | Prevey, III | |
| 6,652,200 | B2 | 11/2003 | Kraemer | |
| 6,658,907 | B2 | 12/2003 | Inoue et al. | |
| 6,666,061 | B2 | 12/2003 | Heimann | |
| 6,675,622 | B2 | 1/2004 | Plicht et al. | |
| 6,815,362 | B1 | 11/2004 | Wong et al. | |
| 6,874,344 | B1 | 4/2005 | Junius et al. | |
| 7,076,983 | B2 * | 7/2006 | Chikushi et al. | 72/201 |
| 7,159,433 | B2 * | 1/2007 | Seidel | 72/201 |
| 7,252,024 | B2 * | 8/2007 | Zurecki et al. | 82/50 |
| 2002/0040905 | A1 | 4/2002 | Groll | |
| 2002/0150496 | A1 | 10/2002 | Chandrasekar et al. | |
| 2002/0174528 | A1 | 11/2002 | Prevey, III | |
| 2002/0189413 | A1 | 12/2002 | Zurecki et al. | |
| 2003/0110781 | A1 | 6/2003 | Zurecki et al. | |
| 2003/0145694 | A1 | 8/2003 | Zurecki et al. | |
| 2004/0043626 | A1 | 3/2004 | Chou San et al. | |
| 2004/0154443 | A1 | 8/2004 | Zurecki et al. | |
| 2004/0232258 | A1 | 11/2004 | Cerv et al. | |
| 2004/0234350 | A1 | 11/2004 | Jager et al. | |
| 2004/0237542 | A1 | 12/2004 | Zurecki et al. | |
| 2005/0011201 | A1 | 1/2005 | Zurecki et al. | |
| 2005/0016337 | A1 | 1/2005 | Zurecki et al. | |
| 2005/0211029 | A1 | 9/2005 | Zurecki et al. | |
| 2007/0175255 | A1 | 8/2007 | Pawelski et al. | |

FOREIGN PATENT DOCUMENTS

| | | | |
|---|---|---|---|
| DE | 4326517 | A1 | 8/1993 |
| DE | 19600172 | A1 | 8/1997 |
| DE | 19730539 | | 4/1999 |
| EP | 0842722 | A1 | 5/1998 |
| EP | 0711663 | B1 | 7/1999 |
| EP | 0945222 | A2 | 9/1999 |
| EP | 1580284 | A2 | 9/2005 |
| EP | 1637257 | A1 | 3/2006 |
| FR | 2724337 | A1 | 3/1996 |
| FR | 2804492 | A1 | 8/2001 |
| JP | 328397 | | 11/1953 |
| JP | 6210105 | | 1/1987 |
| JP | 63-62637 | | 12/1988 |
| JP | 6031502 | A1 | 2/1994 |
| JP | 6330077 | A2 | 11/1994 |
| JP | 09-300172 | | 11/1997 |
| JP | 11320328 | A1 | 11/1999 |
| JP | 200065291 | A1 | 3/2000 |
| JP | 2000296438 | A1 | 10/2000 |
| JP | 2002059336 | | 2/2002 |
| JP | 11156669 | A1 | 12/2007 |
| WO | 92/16464 | A1 | 10/1992 |
| WO | 9708486 | | 3/1997 |
| WO | 98/10893 | A1 | 3/1998 |
| WO | 9960079 | | 11/1999 |
| WO | 02096598 | | 5/2002 |
| WO | 03022517 | | 3/2003 |
| WO | 03066916 | | 8/2003 |

OTHER PUBLICATIONS

U.S. Appl. No. 09/870,853, filed May 31, 2001, Zurecki et al.

"Numerical and Experimental Simulation for Cutting Temperature Estimation using 3-dimensional Inverse Heat Conduction Technique," F. R. S. Lima, et al.

"Mechanical Engineering Handbook (2nd Edition)", Editorial Board of Mechanical Engineering Handbook and Electrical Engineering Handbook, pp. 1-16, 1-30, 4-3 and 2-41, China Machine Press.

D'Errico et al. "Performance of Ceramic Cutting Tools in Turning Operations," Industrial Ceramics, voo. 17, 1997, pp. 80-83.

Edwards, Cutting Tools 1993, The Institute of Materials, London, p. 20.

"Machining," Metals Handbook 9th Edition, vol. 16, 1996.

"Heat Transfer in Cutting Inserts", Kabala Andrze, Experimental Stress Analysis 2001.

Orlowicz, et al., "Effect of Rapid Solidification on Sliding Wear of Iron Castings", Wear 254 (2003), pp. 154-163.

Jajumdar, et al., "Laser Surfacing Alloying - An Advanced Surface Modification Technology", Department of Metallurgical and Materials Engineering Indian Institute of Technology, Kharagpur-721302, India, I. W. W., Technical University of Clausthal, D-38678 Clausthal Zellerfield, Germany, pp. 1-11.

"Thite Layer Formation at Machined Surfaces and . . .," B.J. Griffins, J. of Tribology, vol. 107/165, Apr. 1985.

"Machining Hard Materials with Geometrically . . .," W. Konig, et al, Annals of CIRP, vol. 57, 1990.

"Potential and Limitations of Hard Turning . . .," H.K. Tonshoff, et al, 1st Int. Machining and Grinding Conf. 1995.

"PCBN Tool Failure Mode Analysis," T.J. Broskea, Intertech 2000.

"Process Effects on White Layer Formation in Hard Turning," Y.K. Chou, et al, NAMRI/SME, 1998.

Biomedical Instrumentation and Tech., "Development of a High-Performance Multiprobe Cryosurgical Device", Chang, et al, 1994.

Thiele, et al., "Effect of Cutting Edge Geometry and Workpiece Hardness on Surface Generation in the finish Hard Turning of AISI 52100 Steel", Journal of Materials Processing Technology, 94 (1999), pp. 216-226.

Ozel, et al., "Effects of Cutting Edge Geometry, Workplace Hardness, Feed Rate and Cutting Speed on Surface Roughness and Forces in Finish Turning of Hardened AISI H13 Steel", Department of Industrial and Systems Engineering, Rutgers, The State University of New Jersey, Piscataway, New Jersey 08854 UDS, pp. 1-33.

J.Y. Huang, et al., "Microstructure of Cryogenic Treated M2 Tool Steel," Materials Science and Engineering A339 (2003) 241-244.

Chang-Xue (Jack) Feng, "An Experimental STudy of the Impact of TUrning Parameters on Surface Roughness", Paper No. 2036, Proceedings of the 2001 Industrial Engineering Research Conference, pp. 1-9.
F. Gunnberg, "Surface Integrity Generated by Hard Turning," Thesis, Dept. of Product Development, Chalmers University of Technology of Technology, Goteborg, Sweden, 2003.
Mehrotra, P. K., PH.D.; "Applications of Ceramic Cutting Tools"; Key Engineering Materials; Trans Tech Publications, Switzerland, 1998; vol. 138-140; pp. 1-24.
Dewes, R.C., et al; "The Use of High Speed Machining for the Manufacture of Hardened Steel Dies"; Trans. NAMRI/SME; 1996; pp. 21-26.
"Transport Phenomena," R. R. Bird et al., John Wiley & Sons, 1960.
E. M. Trent and P. K. Wright, "Metal Cutting", 4th Ed., Butterworth, Boston, Oxford, 2000.
ASM Handbook, 9th Ed., vol. 16, "Machining Ceramic Materials," 1995.
Zurecki, Z., et al; "Industrial Systems for Cost Effective Maching of Metals Using an Environmentally Friendly Liquid Nitrogen Coolant"; Aerospace Mfg. Tech. Conf; Jun. 2-4, 1998; Paper No. 981,865.
Zurecki, Z., et al; "Dry Machining of Metals with Liquid Nitrogen"; 3rd Intl. Machining & Grinding '99 Conference and Exposition; Oct. 4-7, 1999; Cincinnati, OH; pp. 1-26.
Lin, J., et al; "Estimation of Cutting Temperature in High Speed Machining"; Trans. of the ASME; vol. 114; Jul. 1992; pp. 290-296.
S545-type milling cutter made by Niagara Cutter (http://www.niagaracutter.com/techinfo).
"Machining Data Handbook," 3rd Edition, vol. 1 and 2, Machinability DataCenter, IAMS, Inc. 1980.
"Application of Metal Cutting Theory," F. E. Gorczyca, Industrial Press, New York, 1987.
"Analysis of Material Removal Processes," W. R. DeVries, Springer Texts in Mechanical Eng., Springer-Verlag, 1992.
"Ceramics and Glasses, Engineered Materials Handbook," vol. 4, ASM Int., The Matls Information Soc., '91.
ASM Specialty Handbook, "Tool Materials," Ed. J. R. Davis, 1998.
"Microstructural Effects in Precision Hard Tuning," Y. K. Chou; C. J. Evans, MED-vol. 4, Mfg. Sci. and Engr., ASME 1996.
Kitagawa, T., et al., "Temperature and wear of cutting in high-speed machining of Inconel 718 and Ti6AI-6V-2Sn"; Wear 202; 1997; Elsevier; pp. 142-148.
"The Lindenfrost phenomenon", F. L. Curzon, Am. J. Phys., 46 (8), Aug. 1978, pp. 825-828.
"A boiling heat transfer paradox", G. G. Lavalle et al., Am. J. Phys., vol. 60, No. 7, Jul. 1992, pp. 593-597.
"Cooling by Immersion in liquid nitrogen", T. W. Listerman et al., Am. J. Phys., 54 (6), Jun. '86, pp. 554-558.
"An Analytical Method to Determine the Liquid Film Thickness Produced by Gas Atomized Sprays", J. Yang et al., J. of Heat Transfer, Feb. 1996, vol. 118, pp. 255-258.
"Optimizing and Predicting Critical Heat Flux in Spray Cooling of a Square Surface", I. Mudawar and K. A. Estes, J. of Heat Transfer, Aug. 1996, vol. 118, pp. 672-679.
"Film Boiling Inder an Impinging Cryogenic Jet", R. F. Barron and R. S. Stanley, Advances in Cryogenic Engineering, vol. 39, Ed. P. Kittel, Plenum Press, New York, 1994, pp. 1769-1777.
"CRC Materials Sci. & Engineering Handbook," 2nd Edition, CRC Press, 1994, Edited by J. F. Shackelford et al.
U.S. Appl. No. 10/066,830, filed Feb. 4, 2002, Zurecki et al.
U.S. Appl. No. 09/951,195, filed Sep. 13, 2001, Zurecki et al.
U.S. Appl. No. 10/809,773, filed Mar. 25, 2004, Zurecki et al.
U.S. Appl. No. 11/221,718, filed Sep. 9, 2005, Ghosh et al.
U.S. Appl. No. 11/250,346, filed Oct. 14, 2005, Zurecki et al.

* cited by examiner

CRYOFLUID ASSISTED FORMING METHOD

BACKGROUND OF THE INVENTION

The configuration of a solid material workpiece can be altered by processes in which material is removed from the workpiece, in which the workpiece is separated into multiple pieces with or without the removal of material, or in which the shape of the workpiece is altered without any significant material removal. Exemplary shaping processes include, for example, machining/turning, grinding, drilling, tapping, sawing, milling, and planing. In these shaping processes, material is removed from the workpiece during the process. In a forming process, the shape, thickness, diameter, or any other physical configuration of the workpiece is altered without any significant material removal, or the workpiece is separated into multiple pieces without any significant material removal. Typical forming processes include, for example, extruding, stamping, profiling, bending, slitting, shearing, drawing, forging, and punching. Any of these processes can be applied to solid metallic or non-metallic materials.

Forming processes are characterized by forcible contact of a tool with the workpiece in which the tool deforms the workpiece. In the process, external heat is generated by surface friction between the tool and the workpiece, and internal heat is generated by deformation of the workpiece material. In order to prevent overheating of the tool and workpiece, a coolant or a combined lubricant/coolant fluid such as a water-oil emulsion can be applied to the tool and/or workpiece. The cooling and lubrication properties of a coolant/lubricant fluid are critical in decreasing tool wear and extending tool life. Cooling and lubrication also are important in achieving the desired size, finish, and shape of the workpiece. A secondary function of the coolant/lubricant may be to prevent marring of the finished surface. Various additives and surfactants can be added to the coolant and lubricant fluids to enhance performance. In certain applications, particularly metalworking applications, cryogenic fluids are used to provide effective cooling.

These processes have been well-developed and are widely used on metals, plastics, and other materials in various manufacturing industries. While the art of forming of materials is well-developed, there remains a need for further innovation and improvements in forming processes. This need is addressed by the embodiments of the present invention as described below and defined by the claims that follow.

BRIEF SUMMARY OF THE INVENTION

An embodiment of the invention relates to a method of forming a workpiece comprising (a) providing a tool and a workpiece, wherein the workpiece has an initial shape; (b) placing the workpiece and the tool in contact, applying force to the tool and/or the workpiece, and moving the tool and/or the workpiece to effect a change in the initial shape of the workpiece by forming; and (c) providing a jet of cryogenic fluid and impinging essentially all of the jet of cryogenic fluid on a surface of the tool.

The workpiece may be plastically deformed by the tool. The workpiece may be separated into two or more pieces by the tool. A lubricant may be applied to any area on a surface of the tool and/or to any area on a surface of the workpiece. The lubricant may comprise a powder entrained in the jet of cryogenic fluid; alternatively, the lubricant may be a liquid sprayed onto the tool and/or workpiece in combination with impinging essentially all of the jet of cryogenic fluid on a surface of the tool. When a lubricant is used, the surface energy of the tool and/or the workpiece may be less than about 38 milliNewtons per meter (38 mN/m). The amount of lubricant applied to the tool and/or the workpiece may be less than about 100 milligrams per square foot. The lubricant may be a solid or semi-solid and the lubricant may be applied by pressing or smearing onto the tool and/or workpiece. The workpiece may comprise metal.

Typically, essentially no cooling of the workpiece is effected by impingement of the jet of cryogenic fluid on a surface of the tool. The cryogenic fluid may be selected from the group consisting of nitrogen, argon, carbon dioxide, and mixtures thereof.

The forming method may be selected from the group consisting of contour and profile roll forming, power spinning, roll forging, orbital forging, shoe-type pinch rolling, alligator shearing, guillotine shearing, punch parting, rotary shearing, line shearing, slitting, wire and rod drawing, tube drawing, moving mandrel drawing, punch drawing, moving insert straightening, die and punch press bending, hammer forming, and die forging.

Another embodiment of the invention includes a method of forming a workpiece comprising (a) providing a tool and a workpiece, wherein the workpiece has an initial shape; (b) placing the workpiece and the tool in contact, applying force to the tool and/or the workpiece, and moving the tool and/or the workpiece to effect a change in the initial shape of the workpiece by forming; and (c) providing a jet of cryogenic fluid and impinging at least a portion of the jet of cryogenic fluid on a surface of the tool while impinging essentially none of the jet of cryogenic fluid on the workpiece.

An alternative embodiment of the invention relates to a method of forming a workpiece comprising (a) providing a tool and a workpiece, wherein the workpiece has an initial shape; (b) placing the workpiece and the tool in contact, applying force to the tool and/or the workpiece, moving the tool and/or the workpiece to effect a change in the initial shape of the workpiece by forming; (c) providing a jet of cryogenic fluid and impinging at least a portion of the jet of cryogenic fluid on a surface of the tool; and (d) terminating contact of the tool and workpiece; wherein the geometric average temperature of the tool may be less than the geometric average temperature of the workpiece. The forming method may be selected from the group consisting of contour and profile roll forming, power spinning, roll forging, orbital forging, shoe-type pinch rolling, alligator shearing, guillotine shearing, punch parting, rotary shearing, line shearing, slitting, wire and rod drawing, tube drawing, moving mandrel drawing, punch drawing, moving insert straightening, die and punch press bending, hammer forming, and die forging.

Another alternative embodiment of the invention includes a shaped article made by a method comprising (a) providing a tool and a workpiece, wherein the workpiece has an initial shape; (b) placing the workpiece and the tool in contact, applying force to the tool and/or the workpiece, and moving the tool and/or the workpiece to effect a change in the initial shape of the workpiece by forming; (c) providing a jet of cryogenic fluid and impinging essentially all of the jet of cryogenic fluid on a surface of the tool; and (d) forming the workpiece into a final shape to provide the shaped article.

A related embodiment of the invention includes a shaped article made by a method comprising (a) providing a tool and a workpiece, wherein the workpiece has an initial shape; (b) placing the workpiece and the tool in contact, applying force to the tool and/or the workpiece, and moving the tool and/or the workpiece to effect a change in the initial shape of the workpiece by forming; (c) providing a jet of cryogenic fluid and impinging at least a portion of the jet of a jet of cryogenic fluid on a surface of the tool while impinging essentially none of the jet of cryogenic fluid on the workpiece; and (d) forming the workpiece into a final shape to provide the shaped article.

Another related embodiment relates to-a shaped article made by a method comprising (a) providing a tool and a workpiece, wherein the workpiece has an initial shape; (b) placing the workpiece and the tool in contact, applying force to the tool and/or the workpiece, moving the tool and/or the workpiece to effect a change in the initial shape of the workpiece by forming; (c) providing a jet of cryogenic fluid and impinging at least a portion of the jet of cryogenic fluid on a surface of the tool; and (c) forming the workpiece into a final shape to provide the shaped article; and terminating the contact of the tool and the shaped article; wherein the geometric average of the temperature of the tool may be less than the geometric average of the temperature of the shaped article.

A final embodiment of the invention relates to an apparatus for processing a workpiece comprising (a) a tool and a workpiece, wherein the workpiece has an initial shape; (b) means for placing the workpiece and the tool in contact to form an interface, means for applying force to the tool and/or the workpiece, and means for moving the tool and/or the workpiece to effect a change in the initial shape of the workpiece; and (c) a cryogenic fluid application system adapted for providing a jet of cryogenic fluid and impinging essentially all of the jet of cryogenic fluid on a surface of the tool. The forming apparatus may be selected from the group consisting of contour and profile roll forming systems, power spinning systems, roll forging systems, orbital forging systems, shoe-type pinch rolling systems, alligator shearing systems, guillotine shearing systems, punch parting systems, rotary shearing systems, line shearing systems, slitting systems, wire and rod drawing systems, tube drawing systems, moving mandrel drawing systems, punch drawing systems, moving insert straightening systems, die and punch press bending systems, hammer forming systems, and die forging systems.

DETAILED DESCRIPTION OF THE INVENTION

Figure 1B:
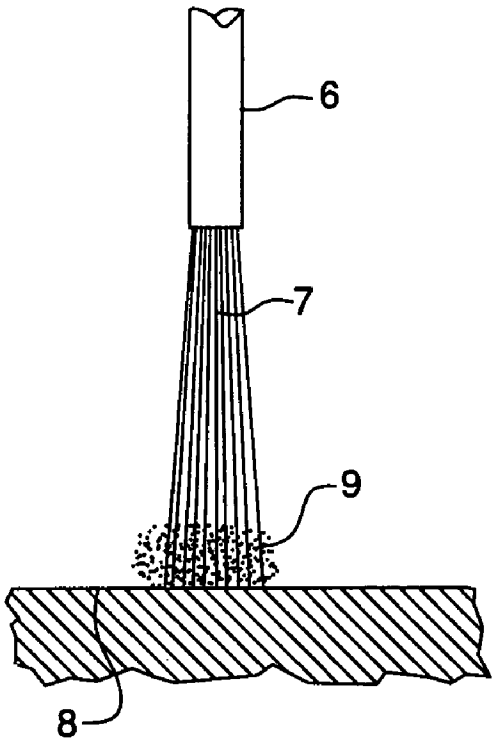
FIG. 1B is a schematic diagram of the splash pattern of a cryogenic fluid coolant stream that impinges on a target surface.

Forming operations modify the geometry of a work material or workpiece by plastic deformation and/or shearing under the contact stress of a tool sliding in some fashion over the surface of the work material or workpiece. This relative motion or sliding of the work material and the tool surfaces may result in localized heating, tool surface softening, wear, and seizures or fractures. Effective cooling of the surface and reduction of adhesive sticking between the tool and the work material have been recognized as critical for achieving high production rates., and the conventional solution involves application of lubricating coolants, oils, metallic soaps, and greases to the surfaces of the work material and the tool. The most frequently used lubricating media include straight and compounded oils with sulfur and chlorine, graphite, wax, fluorinated polymer additives, solvents, surfactants, phosphorus, molybdenum disulfide, and biocides. Typical examples of metal forming operations which involve these lubricating media include blanking, piercing, slitting, drawing, spinning, roll forming, and forging. Due to recently recognized negative effects of these lubricants on health, environment, and process economics, which increase costs of cleaning operations, it is desired to minimize or eliminate these lubricants.

The embodiments of the present invention eliminate or at least minimize the usage of lubricating media without affecting the conventional metal forming rate by replacing or augmenting them with completely innocuous, environmentally-friendly, and clean cryogenic gases. Although not lubricating, the cryogenic gases in the gas-phase, liquid-phase, and multiphase form can cool the surface of the tool to the point at which the loss of tool hardness and increase in friction coefficient are arrested, and forming may be carried out more effectively than in the case of a completely dry operation. The effect of cooling on hardness, strength, and impact resistance of metals is increased because conductive and convective heat transfer is enhanced by the large temperature difference between the cryogenic cooling medium and the target material. Thus the embodiments of the invention utilize the impingement of a fast-moving cryogenic jet (or jets) on the surface of the forming tool while avoiding or minimizing contact of the cryogen with the work material. This allows the tool to retain the desired hardness and strength while the work material is free to soften and plastically flow or shear during forming.

In experimental work supporting development of the embodiments of the invention, it was discovered that an expanding cryogenic jet does not splash after impacting a tool surface, and as a result does not contact and cool the work material. This selective cooling of the tool but not the work material thus is possible by proper application of a cryogenic fluid using methods described herein. The methods may be applied to metal forming operations in which cryogenic coolant is aimed at the tool surface only such that the work material in proximity of the tool is not cooled significantly. Typically, the temperature of the work material is above the freezing point of water. In some embodiments, the geometric average temperature of the tool is less than the geometric average temperature of the work material or workpiece. In other embodiments, the geometric average temperature of the tool is above the geometric average temperature of the workpiece but below a temperature at which the tool properties (for example, hardness) are adversely affected.

Figure 1A:
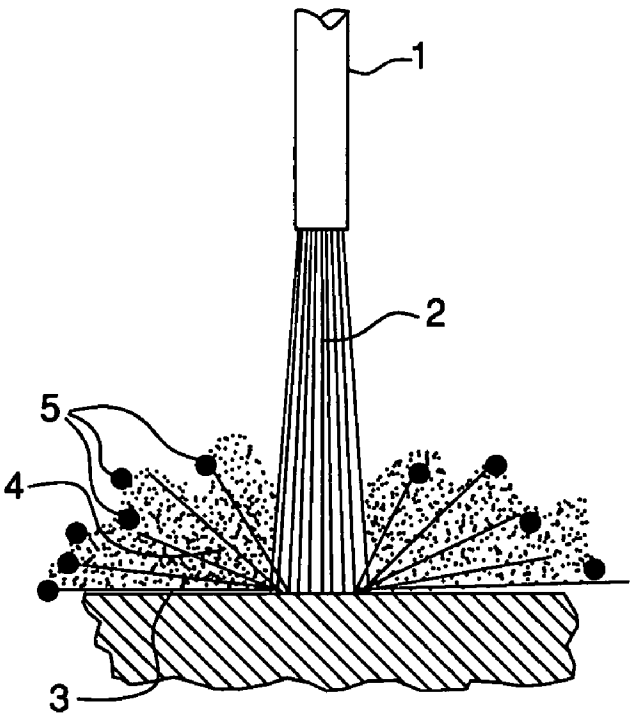
FIG. 1A is a schematic diagram of the splash pattern of a water or oil-based coolant stream that impinges on a target surface.

The impingement of conventional and cryogenic fluid streams on the surface of a workpiece is illustrated in FIGS. 1A and 1B, respectively. In FIG. 1A, nozzle 1 discharges spray or jet 2 of a cooling liquid (typically at or near ambient temperature) that impinges upon surface 3. The liquid may be water, oil, a water/oil emulsion, or other similar liquid. As the liquid impinges upon and cools the surface, splash zone 3 is formed and liquid droplets 5 are rejected outward from the splash zone. Some vaporization may occur in splash zone 3, but the major portion of the coolant remains in the liquid phase. When surface 3 is a surface of a tool in contact with a workpiece (not shown), these droplets may fall on the workpiece and cool the workpiece.

In FIG. 1B, nozzle 6 discharges spray or jet 7 of a cryogenic fluid that impinges upon and cools surface 8. An intense vaporization zone 9 is formed wherein essentially all cryogenic fluid that is in the liquid phase in the zone is vaporized, and no significant amount of unvaporized liquid is rejected outward from this zone. When surface 8 is a surface of a tool in contact with a workpiece (not shown), essentially no cooling of the workpiece is caused by residual cryogenic liquid rejected from the vaporization zone.

When lubricants are used in conjunction with cryogenic cooling of the tool, methods can be used to minimize the quantity of the lubricants. In one embodiment, microscopic quantities of oil mist may be co-sprayed toward the surface of the tool or toward the surfaces of both the tool and the work material while the cryogenic fluid is sprayed on the tool. Alternatively or additionally, finely-divided particles of lubricant material may be suspended in the cryogenic fluid sprayed on the tool surface. In another embodiment, microscopic quantities of solid lubricant may be smeared over the tool or both the tool and work material surfaces.

Due to recently-recognized negative effects of conventional lubricants on health, the environment, and process economics, the costs of operations to clean formed articles have increased significantly. It is desired, therefore, to reduce or eliminate these lubricants. The embodiments of the invention eliminate or at least minimize the use of lubricating media without affecting the conventional metal forming rate by using innocuous, environmentally-friendly, and clean cryogenic fluids in the forming process.

In the present disclosure, the term "forming" is defined as a process in which the shape of a workpiece or work material is changed by contact with a tool without the removal of material from the workpiece or without the removal of any significant amount of material from the workpiece. A very small and insignificant amount of material may be worn off the workpiece by friction between the tool and workpiece. In a forming process, in contrast with a shaping process, there is no deliberate removal of material from the workpiece by grinding, milling, planing, sawing, drilling, machining, and the like.

In the present disclosure, the term "cryogenic fluid" means a gas, a liquid, solid particles, or any mixture thereof at temperatures below about minus 100° C. Cryogenic fluids for use in embodiments of the present invention may comprise, for example, nitrogen, argon, carbon dioxide, or mixtures thereof. A lubricant is defined as any of various oily liquids and/or greasy solids that reduce friction, heat, and wear when applied to parts that are in movable contact. The lubricant may be essentially water-free, or alternatively may contain water. Exemplary lubricants for use in embodiments of the present invention include, but are not limited to, Quakerol-800, a lubricating fluid available from Quaker Chemical Corp.; Gulf Stainless Metal Oils produced by Gulf Lubricants; Rolube 6001 fluids for forming non-ferrous metals available from General Chemical Corp.; and a range of other, mineral, synthetic, or soluble oil fluids and wax suspensions formulated for forming, rolling, cutting, and grinding operations. Oil-water emulsions may be considered as lubricants when used in embodiments of the invention.

The terms "apply", "applying", or "applied" as used for a cryogenic fluid mean spraying, jetting, or otherwise directing the fluid to contact and cool any external surface of a tool while the workpiece and the tool are in contact. In a cyclic forming process, in which the tool and workpiece are in intermittent contact, the fluid also may be applied to the tool during at least a portion of the time period when there is no tool/workpiece contact. The terms "apply", "applying", or "applied" as used for a liquid lubricant mean spraying, jetting, flooding, misting, or otherwise directing the lubricant to contact the surface of a tool or workpiece and to penetrate and/or fill the microscopic regions formed by the surface asperities on the tool and/or workpiece. The terms "apply", "applying", or "applied" as used for a solid or semi-solid lubricant mean pressing, rubbing, smearing, or otherwise directing the solid lubricant to contact the surface of a tool or workpiece and to penetrate and/or fill the microscopic regions formed by the surface asperities on the tool and/or workpiece.

The term "surface" as used in reference to a tool or a workpiece means any external surface of the tool or workpiece. The term "area" as used in reference to a tool or a workpiece refers to a region on any external surface of the tool or workpiece.

When a jet of cryogenic fluid is applied to the surface of a tool, essentially all of the jet impinges on a surface of the tool. The term "essentially all" means that at least 90% of the fluid in the jet impinges on the tool surface. Essentially none of the jet of cryogenic fluid impinges on the workpiece. The term "essentially none" means that less that 10% of the jet of cryogenic fluid impinges on the workpiece. Essentially no cooling of the workpiece is effected by impingement of the jet of cryogenic fluid on the tool. The term "essentially no cooling" means that the geometric average temperature of the workpiece, which may be affected by small amounts of stray cryogenic fluid from the tool surface, changes by less than 10° C. due to contact with this stray cryogenic fluid.

The indefinite articles "a" and "an" as used herein mean one or more when applied to any feature in embodiments of the present invention described in the specification and claims. The use of "a" and "an" does not limit the meaning to a single feature unless such a limit is specifically stated. The definite article "the" preceding singular or plural nouns or noun phrases denotes a particular specified feature or particular specified features and may have a singular or plural connotation depending upon the context in which it is used. The adjective "any" means one, some, or all indiscriminately of whatever quantity. The term "and/or" placed between a first entity and a second entity means one of (1) the first entity, (2) the second entity, and (3) the first entity and the second entity.

The geometric average temperature of a workpiece is defined as an arithmetic average of the temperature at discrete points located on the workpiece surface (i.e., the portion of the workpiece surface that comes into contact with the tool surface) during a forming cycle averaged for the time length of the forming cycle.

The geometric average temperature of a tool is defined as an arithmetic average of the temperature at discrete points located on the work surface of the tool (i.e., the portion of the tool surface that comes into contact with the workpiece surface) during a forming cycle averaged for the time length of the forming cycle. For a rotating tool, the discrete points located on the work surface of the tool are the points located on and/or immediately near the perimeter of the tool, and the time length of the forming cycle is the time required for one full revolution of this tool. For an intermittently operating tool (for example, a punch, forming hammer, shearing blade, and the like), the discrete points located on the work surface of the tool are the points located on and/or immediately near the tool face that contacts the workpiece, and the time length of the forming cycle is the time required for moving in, contacting the workpiece, and withdrawing the tool from the workpiece.

The embodiments of the invention are based on the beneficial effect of cryogenic cooling to increase hardness and plastic flow resistance while reducing impact resistance of the tool material. Heat transfer required for cooling can be both conductive and convective, and can be enhanced by the large temperature difference between the cryogenic fluid and the initially ambient temperature of the tool material. Thus, the process utilizes the impingement of a fast-expanding cryogenic jet (or jets) on the surface of the forming tool while avoiding or minimizing the contact of the cryogenic fluid with the workpiece or work material. In this process, the forming tool retains the desired hardness and strength while the work material is thermally unconstrained, i.e., is free to soften under the tool pressure and plastically flow or shear during the forming process.

The temperature of the tool surface may be at or below room temperature, and the allowable lower temperature limit depends on the properties of the tool material. For carbon tool steels and ferritic-martensitic tool steels, the lower temperature limit should be in the range of about minus 30° C. to about minus 50° C., since temperatures below this range would fall under the ductile-brittle transition point of those steels and result in undesired tool embrittlement. In the case of tungsten and/or molybdenum carbide and other hard tool materials, designed to operate within their brittle regimes, the lower temperature limit can be equal to the cryogenic jet temperature.

The cryogenic fluid used for cooling the tool surface can comprise a gas-phase, liquid-phase, solid-phase, or multi-phase stream. The cryogenic fluid may be nitrogen, argon, carbon dioxide, or any mixture of these. The fluid may be liquid, vapor, or multi-phase and may contain solid particles. An advantageous cryogenic fluid is a jet of saturated boiling liquid nitrogen, which produces a large thermal gradient at the tool surface and promotes very rapid cooling of the surface. The process used in the embodiments of the present invention is made possible by an unexpected behavior of such a jet. When the jet (which consists of many very fine liquid droplets in a cryo-vapor envelope) impinges on a tool surface, the jet boils off or evaporates at the point of impact and does not splash away to cool adjacent surfaces and components. Such a jet can be conveniently used for selective cooling of tool surface without undesired cooling of the work material. This observed jet behavior contrasts with that of water or oil-based conventional coolant jets, which tend to splash off and impinge on surrounding surfaces.

Certain work materials (e.g., aluminum) and certain operations (e.g., drawing), as well as aggressive forming conditions, may require the use of minute quantities of lubricating material at the interface between the tool and the work material to prevent frictional welding. In these cases, the cryogenic fluid jet and the lubricating material may be applied simultaneously. The lubricating material may be a microscopic quantity of vegetable oil mist co-sprayed with the cryogen. During experimental tests, co-spraying oil with cryogen did not cause a fog of oil, possibly due to the fact that the cryogen cooled and caused the oil droplets to become tacky. This enabled the oil droplets to stick to the target surface better than in the absence of cryogenic cooling, and oily fogs were not formed as are observed in the conventional art of ambient lubricant spraying.

The lubricating material may be a suspension of micron- and submicron-sized powder suspended in the cryogenic fluid jet, whether the jet is liquid or gaseous. Such fine powders act as a boundary lubricating, dry medium, and can be combined with the cryogenic jet cooling. Finally, the micro-lubricating medium may be a microscopic quantity of solid material that is smeared over the surface of the tool and/or work material by rubbing. The solid medium may be borax, boric acid, hexagonal boron nitride, or similar solids known reduce friction coefficients and prevent interfacial reactions.

In general, boron-based lubricants may be used during forming of non-ferrous metal surfaces, e.g., aluminum surfaces, and in forming operations which should minimize carbon contamination, e.g., forming surfaces of tungsten or molybdenum emission electrodes operating in vacuum or in gaseous atmospheres. LuBoron LCC and BAGL are examples of liquid-phase, orthoboric acid-based lubricants available from Advanced Lubrication Technology, Inc.

The lubricant should be applied in a very small or microscopic quantity such that the lubricant layer cannot be easily detected by visual examination of the covered surface with naked eye or magnifying glass. The presence of such a microlubricating layer may be detected by determining the surface energy of the lubricant-covered surface by any conventional test method, e.g., by spreading droplets of inks of known surface energy. For the embodiments of the present invention, the surface of a micro-lubricated work material or workpiece may have a surface energy of less than about 38 milliNewtons per meter (38 mN/m), and may be considered lubricant-free if the surface energy is above about 46 mN/m. In the case of oil-based lubricants, the amount of microlubricant required to reduce the energy from 46 to 38 mN/m can be less than about 100 milligrams per square foot of work and/or tool surface.

Embodiments of the present invention may be applied to exemplary shaping processes such as, for example, the use of rotating tools for plastic deformation of a workpiece in contour and profile roll forming, power spinning, roll forging, orbital forging, and shoe-type pinch forming. The embodiments also may be applied in the exemplary use of (a) shearing and parting tools for separating workpieces in alligator shearing, guillotine shearing, punch parting, rotary shearing, shearing in a shearing line, and slitting; (b) drawing tools in punch drawing, wire and rod drawing, tube drawing, and moving mandrel drawing; and (c) stroke forming tools in die and punch press bending, moving insert straightening, hammer forming, and die forging. Other shaping processes not listed here also may be amenable to application of the embodiments of the present invention.

Figure 2A:
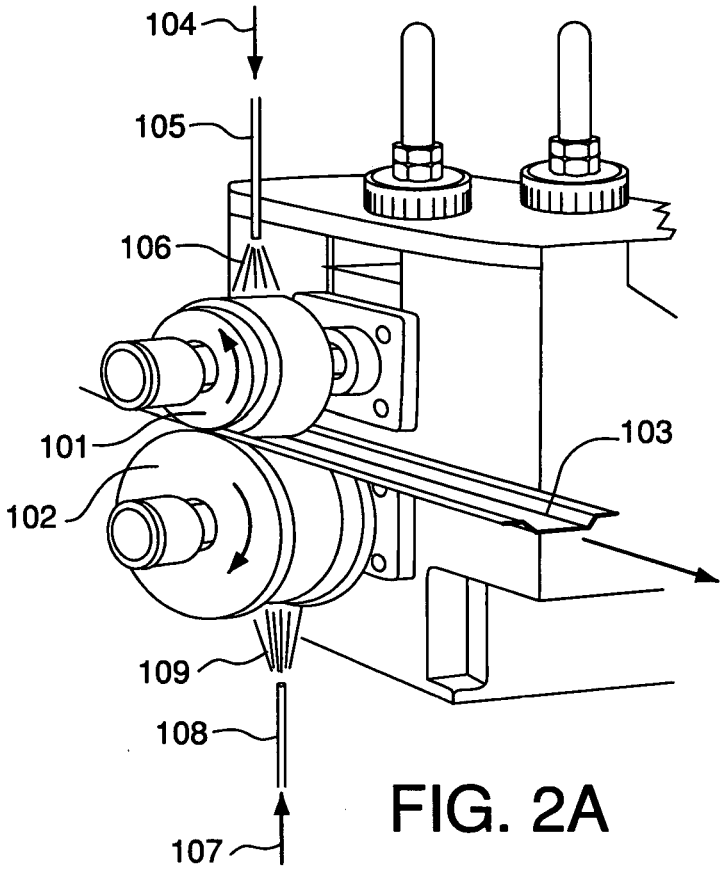
FIG. 2A is a schematic diagram of a contour and profile roll forming system illustrating the location of cryogenic fluid application according to an embodiment of the invention.

An embodiment of the invention is illustrated in FIG. 2A for contour and profile roll forming. In this forming process, a flat feed workpiece (not shown) is fed between upper contour roller 101 and counter-rotating lower contour roller 102 to produce channeled formed product 103. Cryogenic fluid 104 is fed to spray feed line and nozzle 105 to form jet 106 that impinges on upper contour roller 101, thereby cooling the roller. Additionally or alternatively, cryogenic fluid 107 is fed to spray feed line and nozzle 108 to form jet 109 that impinges on lower contour roller 102, thereby cooling the roller. Essentially all of the cryogenic fluid, i.e., at least 90% of cryogenic fluids 104 and 107 and jets 106 and 109, may impinge on the rollers. The use of the cryogenic fluid may cool each roller to a geometric average temperature that is less than the geometric average temperature of channeled formed product 103 following termination of contact of rollers 101 and 102 with formed product 103.

Figure 2B:
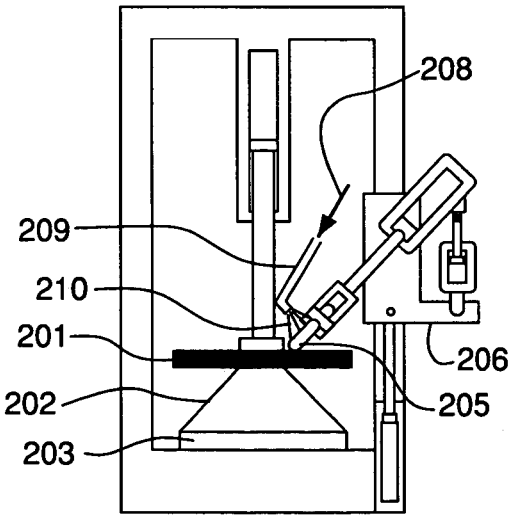
FIG. 2B is a schematic diagram of a power spinning system prior to workpiece deformation illustrating the location of cryogenic fluid application according to an embodiment of the invention.
Figure 2C:
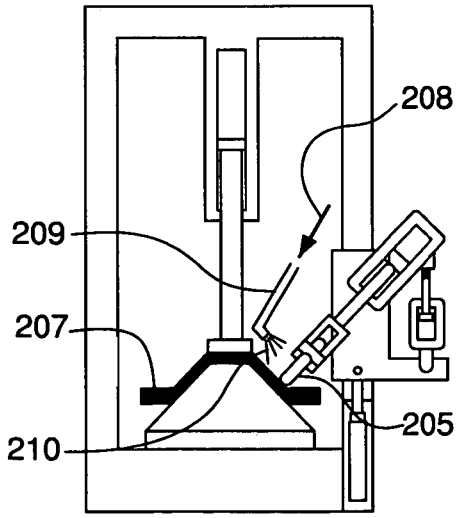
FIG. 2C is a schematic diagram of a power spinning system following workpiece deformation illustrating the location of cryogenic fluid application according to an embodiment of the invention.

Another embodiment of the invention is illustrated in FIGS. 2B and 2C for power spinning. In this forming process, initial blank or workpiece 201 (FIG. 2B) is placed on top of mandrel 202 that is rotated by turntable 203. Roller 205 contacts the rotating workpiece and is forced downward on the workpiece by vertical positioner 206, thereby changing the shape of the workpiece to final shaped product 207 shown in FIG. 2C2B. During shaping, cryogenic fluid 208 is fed to spray feed line and nozzle 209 to form jet 210 that impinges on roller 205, thereby cooling the roller. Essentially all of the cryogenic fluid, i.e., at least 90% of cryogenic fluid 208 and jet 210, may impinge on the roller. The use of the cryogenic fluid may cool the roller to a geometric average temperature that is less than the geometric average temperature of final shaped product 207.

Figure 3:
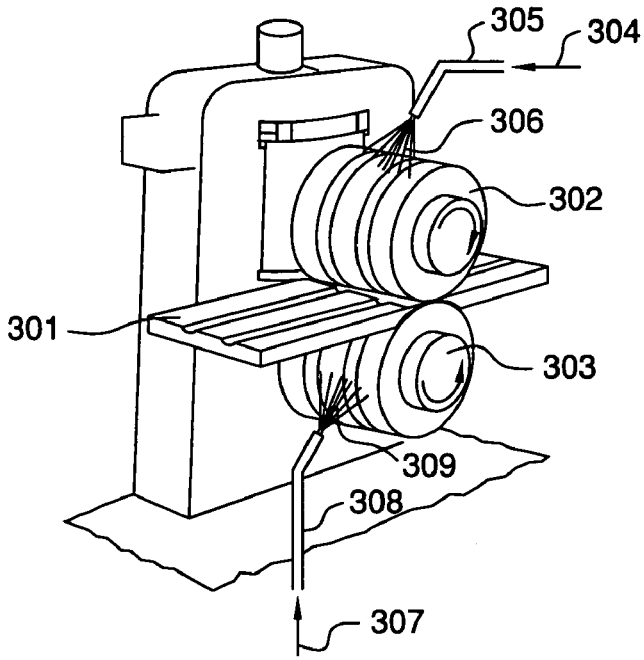
FIG. 3 is a schematic diagram of a roll forging system illustrating the location of cryogenic fluid application according to an embodiment of the invention.

Another embodiment of the invention is illustrated in FIG. 3 for roll forging. In this forming process, a flat feed workpiece (not shown) is fed on table 301 between upper roll die 302 and counter-rotating lower roll die 303 to produce a roll-forged product (not shown). Cryogenic fluid 304 is fed to spray feed line and nozzle 305 to form jet 306 that impinges on upper roll die 302, thereby cooling the roll die. Additionally or alternatively, cryogenic fluid 307 is fed to spray feed line and nozzle 308 to form jet 309 that impinges on lower roll die 303, thereby cooling the roll die. Essentially all of the cryogenic fluid, i.e., at least 90% of cryogenic fluids 304 and 307 and jets 306 and 309, may impinge on the rollers. The use of the cryogenic fluid may cool each roller to a geometric average temperature that is less than the geometric average temperature of the roll-forged product.

Figure 4:
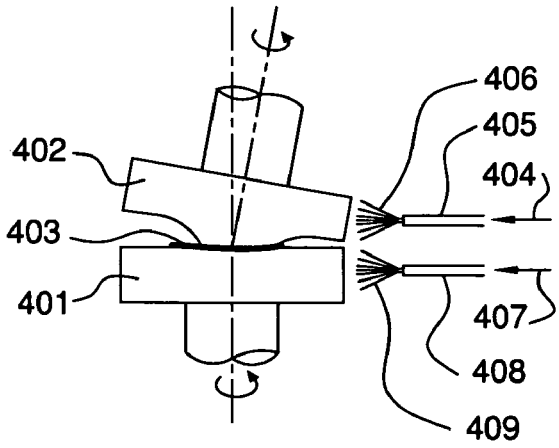
FIG. 4 is a schematic diagram of an orbital forging system illustrating the location of cryogenic fluid application according to an embodiment of the invention.

Another embodiment of the invention is illustrated in FIG. 4 for orbital forging. In this forming process, a flat feed workpiece (not shown) is initially placed on lower die 401. Upper die 402 is lowered and pressed against the feed workpiece as the two dies rotate in the same direction. As upper die 402 (which is convex) is rotated against lower die 401 (which is concave), the feed workpiece is formed to produce orbitally-forged product piece 403. Cryogenic fluid 404 is fed to spray feed line and nozzle 405 to form jet 406 that impinges on upper die 402, thereby cooling the die. Additionally or alternatively, cryogenic fluid 407 is fed to spray feed line and nozzle 408 to form jet 409 that impinges on lower die 401, thereby cooling the roll die. Essentially all of the cryogenic fluid, i.e., at least 90% of cryogenic fluids 404 and 407 and jets 406 and 409, may impinge on the dies. The use of the cryogenic fluid may cool each die to a geometric average temperature that is less than the geometric average temperature of orbitally-forged product 403.

Figure 5:
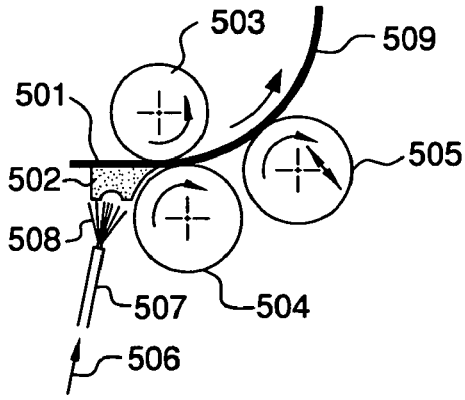
FIG. 5 is a schematic diagram of a shoe-type pinch rolling system illustrating the location of cryogenic fluid application according to an embodiment of the invention.

Another embodiment of the invention is illustrated in FIG. 5 for shoe-type pinch rolling. In this-forming process, workpiece 501 is placed on top of shoe 502 and is contacted by rollers 503, 504, and 505. The rollers and shoe are located to roll bend the workpiece as shown. During rolling, cryogenic fluid 506 is fed to spray feed line and nozzle 507 to form jet 508 that impinges on shoe 502, thereby cooling the shoe. Essentially all of the cryogenic fluid, i.e., at least 90% of cryogenic fluid 506 and jet 507, may impinge on the shoe. The use of the cryogenic fluid may cool the shoe to a geometric average temperature that is less than the geometric average temperature of final roll-bent workpiece 509.

Figure 6:
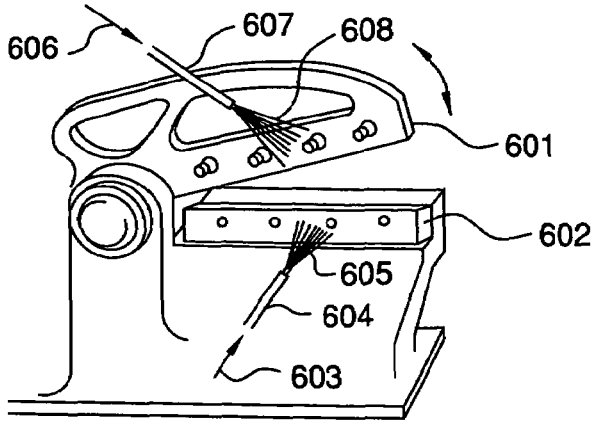
FIG. 6 is a schematic diagram of an alligator shearing system illustrating the location of cryogenic fluid application according to an embodiment of the invention.

Another embodiment of the invention is illustrated in FIG. 6 for alligator shearing. In this forming process, a feed workpiece (not shown) is placed between upper blade 601 and lower blade 602. Upper blade moves downward against the workpiece, forcing it against lower blade 602, thereby causing shearing forces that cut and separate a product piece (not shown) from the feed workpiece. During cutting, cryogenic fluid 603 is fed to spray feed line and nozzle 604 to form jet 605 that impinges on lower blade 602, thereby cooling the blade. Alternatively or additionally, cryogenic fluid 606 is fed to spray feed line and nozzle 607 to form jet 608 that impinges on upper blade 601, thereby cooling the blade. Essentially all of the cryogenic fluid, i.e., at least 90% of cryogenic fluids 603 and 606 and jets 605 and 608, may impinge on the blades. The use of the cryogenic fluid may cool each blade to a geometric average temperature that is less than the geometric average temperature of the product piece.

Figure 7:
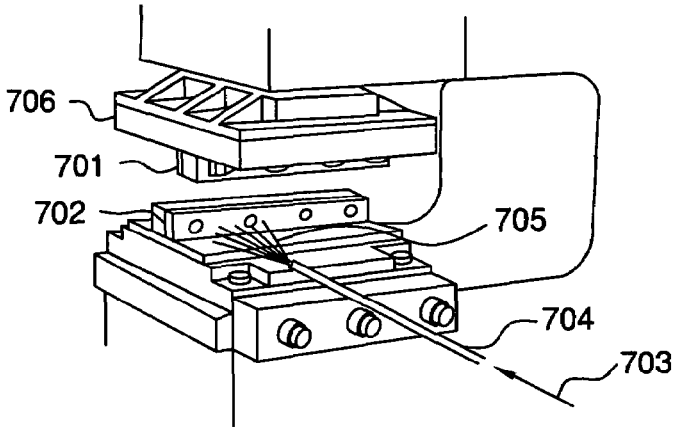
FIG. 7 is a schematic diagram of a guillotine shearing system illustrating the location of cryogenic fluid application according to an embodiment of the invention.

Another embodiment of the invention is illustrated in FIG. 7 for guillotine shearing. In this forming process, a feed workpiece (not shown) is placed between upper blade 701 and lower blade 702. Upper blade moves downward against the workpiece, forcing it against lower blade 702, thereby causing shearing forces that cut and separate a product piece (not shown) from the feed workpiece. During cutting, cryogenic fluid 703 is fed to spray feed line and nozzle 704 to form jet 705 that impinges on lower blade 702, thereby cooling the blade. Additionally or alternatively, cryogenic fluid is fed to another spray feed line and nozzle (not seen behind upper blade 701 and bladeholder 706) to form a jet that impinges on the rear side of upper blade 701, thereby cooling the blade. Essentially all of the cryogenic fluid, i.e., at least 90% of cryogenic fluid 703 and jet 705, as well as the fluid and jet cooling upper blade 701, may impinge on the blades. The use of the cryogenic fluid may cool each blade to a geometric average temperature that is less than the geometric average temperature of the product piece.

Figure 8:
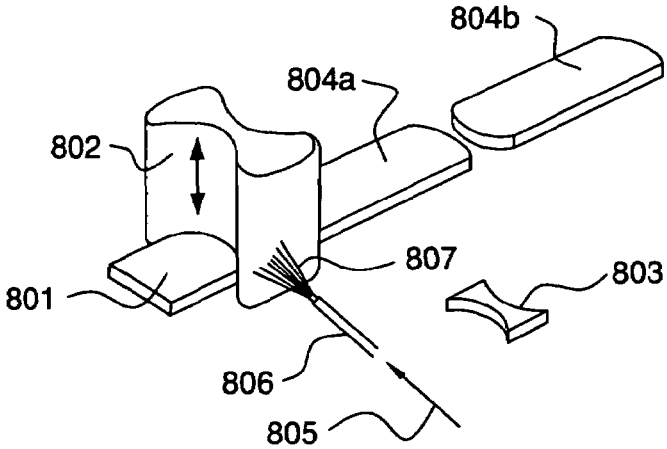
FIG. 8 is a schematic diagram of a punch parting system illustrating the location of cryogenic fluid application according to an embodiment of the invention.

Another embodiment of the invention is illustrated in FIG. 8 for punch parting. In this forming process, feed workpiece 801 is placed on a lower fixed support (not shown) having sufficient clearance to allow full vertical movement of punch 802. The punch moves downward against the workpiece, forcing it against the lower fixed support, thereby causing shearing forces that cut and separate waste piece 803 from feed workpiece 801, thereby forming product pieces 804*a* and 804*b*. During punching, cryogenic fluid 805 is fed to spray feed line and nozzle 806 to form jet 807 that impinges on punch 802, thereby cooling the punch. Additionally or alternatively, cryogenic fluid may be fed to another spray feed line and nozzle (not shown behind punch 802) to form a jet that impinges on the rear side of punch, thereby cooling the punch. Essentially all of the cryogenic fluid, i.e., at least 90% of cryogenic fluid 805 and jet 806, as well as the fluid and jet cooling the back of punch 802, may impinge on the punch. The use of the cryogenic fluid may cool the punch to a geometric average temperature that is less than the geometric average temperature of product piece.

Figure 9:
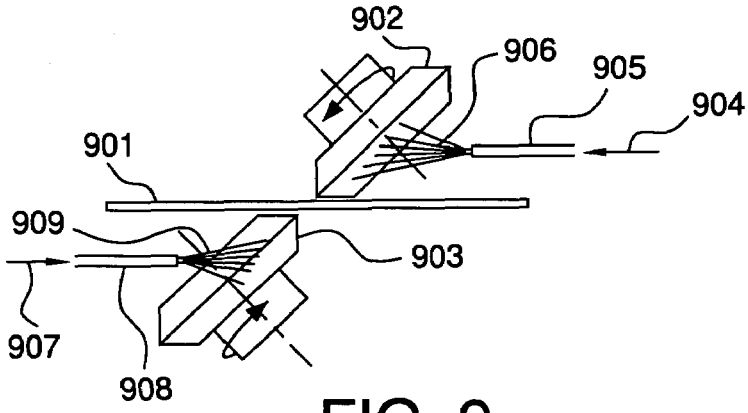
FIG. 9 is a schematic diagram of a rotary shearing system illustrating the location of cryogenic fluid application according to an embodiment of the invention.

Another embodiment of the invention is illustrated in FIG. 9 for rotary shearing. In this forming process, feed workpiece 901 is placed between upper rotary cutter 902 and lower rotary cutter 903. Upper rotary cutter 902 moves downward against the workpiece, forcing it against lower rotary cutter 903, thereby causing shearing forces that cut and separate a product piece (not shown) from feed workpiece 901. During cutting, cryogenic fluid 904 is fed to spray feed line and nozzle 905 to form jet 906 that impinges on upper rotary cutter 902, thereby cooling the cutter. Additionally or alternatively, cryogenic fluid is fed to spray feed line 907 and nozzle 908 to form jet 909 that impinges on lower rotary cutter 903, thereby cooling the cutter. Essentially all of the cryogenic fluid, i.e., at least 90% of cryogenic fluids 904 and 907 and jets 906 and 909, may impinge on the rotary cutters. The use of the cryogenic fluid may cool each cutter to a geometric average temperature that is less than the geometric average temperature of the product piece.

Figure 10:
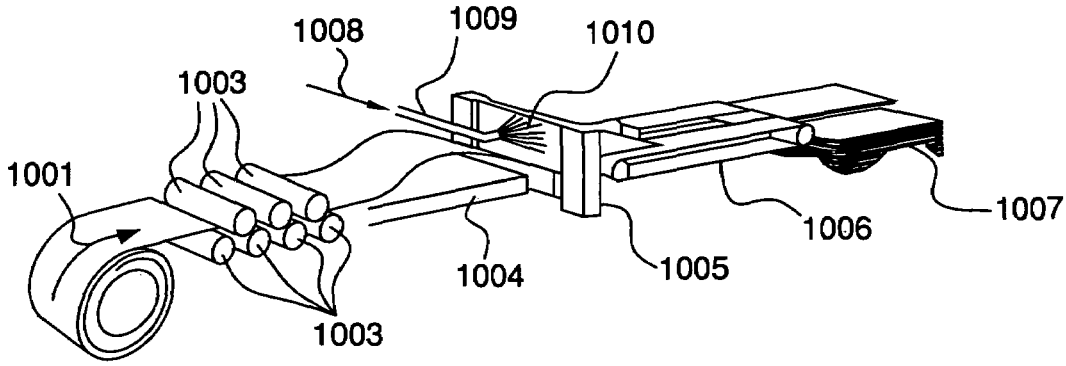
FIG. 10 is a schematic diagram of a shearing line system illustrating the location of cryogenic fluid application according to an embodiment of the invention.

Another embodiment of the invention is illustrated in FIG. 10 for shearing in a shearing line. In this forming process, coilstock 1001 is fed between straightening rolls 1003 and over hump table 1004. Stationary shear 1005 cuts the straightened stock into product sheets that pass over gage table 1006 having a retractable stop and stacker that stacks the cut sheets 1007 as they are delivered from the gage table. Cryogenic fluid 1008 is fed to spray feed line and nozzle 1009 to form jet 1010 that impinges on the blade of stationary shear 1005, thereby cooling the blade. Essentially all of the cryogenic fluid, i.e., at least 90% of cryogenic fluid 1008 and jet 1010, may impinge on the blade. The use of the cryogenic fluid may cool the blade to a geometric average temperature that is less than the geometric average temperature of each product sheet that passes over gage table 1006.

Figure 11:
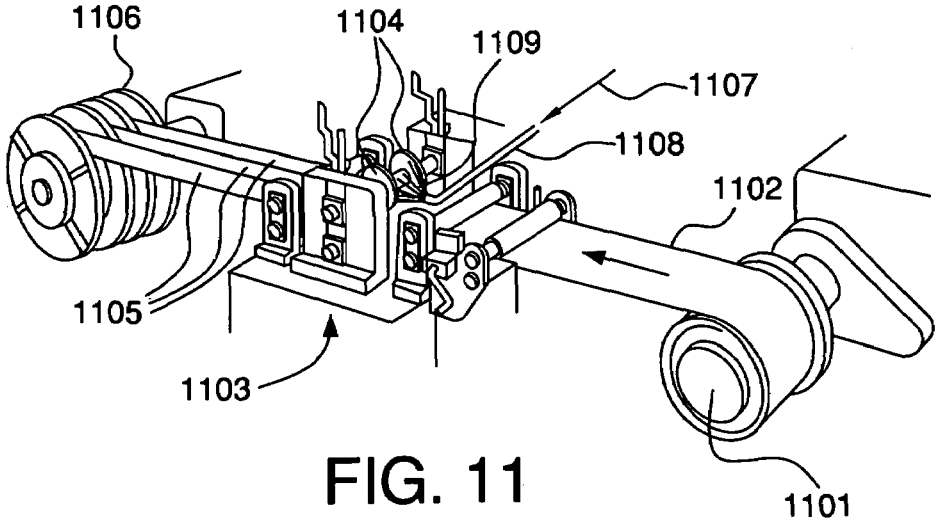
FIG. 11 is a schematic diagram of a slitting line system illustrating the location of cryogenic fluid application according to an embodiment of the invention.

Another embodiment of the invention is illustrated in FIG. 11 for slitting in a slitting line. In this forming process, slitting is accomplished by feeding stock from uncoiler 1101 and passing uncoiled strip 1102 strip to slitter 1103, where it passes between slightly overlapping circular blades 1104 mounted on rotating arbors. Slit product strips 1105 are taken up by recoiler 1106 for simultaneous coiling of all slit strips. Cryogenic fluid 1107 is fed to spray feed line and nozzle 1108 to form jet 1109 that impinges on the circular blades 1104, thereby cooling the blades. Essentially all of the cryogenic fluid, i.e., at least 90% of cryogenic fluid 1107 and jet 1109, may impinge on the blades. The use of the cryogenic fluid may cool the blades to a geometric average temperature that is less than the geometric average temperature of each product strip 1105.

Figure 12:
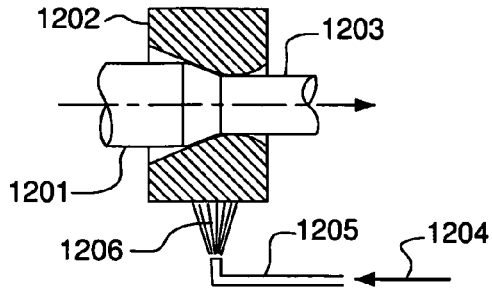
FIG. 12 is a schematic diagram of a wire and rod drawing system illustrating the location of cryogenic fluid application according to an embodiment of the invention.

Another embodiment of the invention is illustrated in FIG. 12 for wire and rod drawing. In this forming process, feed workpiece 1201 having a given diameter is fed through die 1202 to deform the feed workpiece and reduce the diameter to yield drawn product 1203 having a reduced diameter. Cryogenic fluid 1204 is fed to spray feed line and nozzle 1205 to form jet 1206 that impinges on die 1202, thereby cooling the die. Additional cryogenic fluid may be applied (not shown) at other radial locations on the die. Essentially all of the cryogenic fluid, i.e., at least 90% of cryogenic fluid 1204 and jet 1206 (and/or cryogenic fluid applied at other radial locations on the die) may impinge on the die. The use of the cryogenic fluid may cool die 1202 to a geometric average temperature that is less than the geometric average temperature of drawn product 1203.

Figure 13:
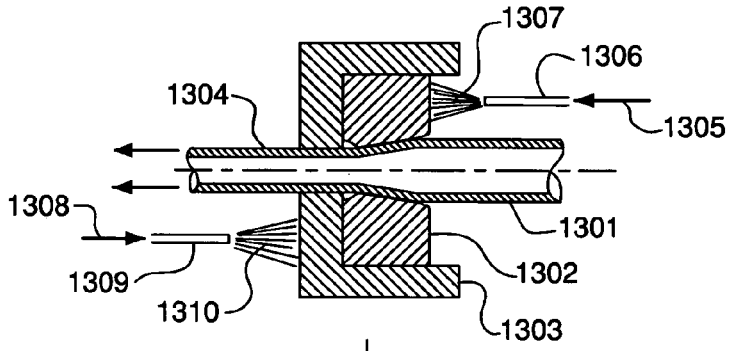
FIG. 13 is a schematic diagram of a tube drawing (sinking) system illustrating the location of cryogenic fluid application according to an embodiment of the invention.

Another embodiment of the invention is illustrated in FIG. 13 for tube drawing or sinking. In this forming process, feed tubing workpiece 1301 having a given outer diameter is fed through die 1303 held in frame 1303 to deform the feed workpiece and reduce the diameter to yield drawn tube product 1304 having a reduced diameter. Cryogenic fluid 1305 is fed to spray feed line and nozzle 1306 to form jet 1307 that impinges on die 1302, thereby cooling the die. Cryogenic fluid may be applied to any location on the die, including more than one location. In addition to or as an alternative to applying cryogenic fluid to the die, cryogenic fluid may be applied to any location on frame 1303 as illustrated by cryogenic fluid 1308, feed line and nozzle 1309, and jet 1310. Essentially all of the cryogenic fluid, i.e., at least 90% of cryogenic fluid 1305 and jet 1307 (and/or cryogenic fluid applied at other radial locations on the die and at locations on the frame) may impinge on the die and frame. The use of the cryogenic fluid may cool each of die 1302 and frame 1303 to a geometric average temperature that is less than the geometric average temperature of drawn product 1304.

Figure 14:
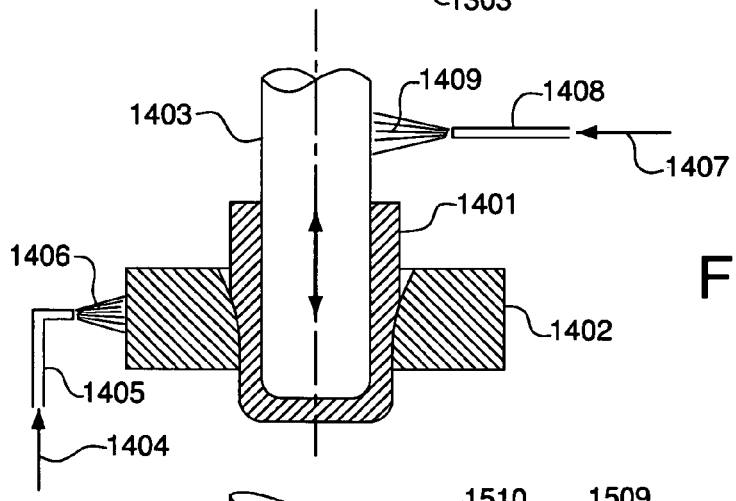
FIG. 14 is a schematic diagram of a moving mandrel drawing system illustrating the location of cryogenic fluid application according to an embodiment of the invention.

Another embodiment of the invention is illustrated in FIG. 14 for tube drawing with a moving mandrel. In this forming process, workpiece 1401 having a given outer diameter is pushed through die 1402 by moving mandrel 1403 to deform the feed workpiece and reduce the diameter to yield a final drawn product piece (not shown) having a reduced diameter. Cryogenic fluid 1404 is fed to exemplary spray feed line and nozzle 1405 to form jet 1406 that impinges on die 1402, thereby cooling the die. Cryogenic fluid may be applied at any location (including more than one location) on the die. In addition to or as an alternative to applying cryogenic fluid to the die, cryogenic fluid may be applied to any location on mandrel 1403 as illustrated by cryogenic fluid 1407, feed line and nozzle 1408, and jet 1409. This application may be done while the mandrel is at any position as it moves axially. Essentially all of the cryogenic fluid, i.e., at least 90% of cryogenic fluid 1404 and jet 1406 (and/or cryogenic fluid applied at other radial locations on the die and at locations on the frame) may impinge on the die and frame. The use of the cryogenic fluid may cool each of die 1302 and frame 1303 to a respective geometric average temperature that is less than the geometric average temperature of the final drawn product.

Figure 15:
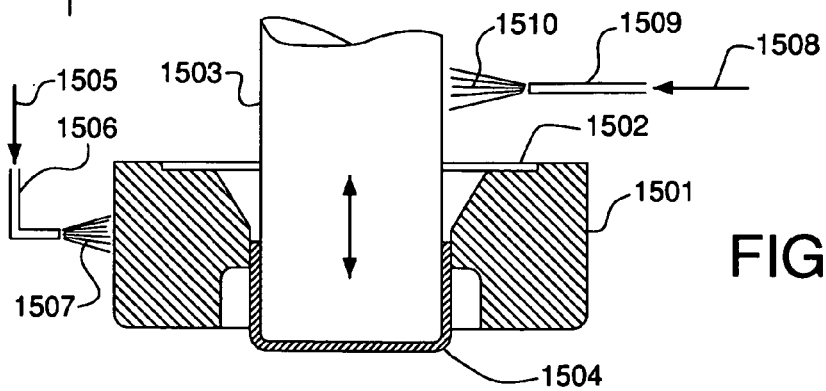
FIG. 15 is a schematic diagram of a punch drawing system illustrating the location of cryogenic fluid application according to an embodiment of the invention.

Another embodiment of the invention is illustrated in FIG. 15 for punch drawing with a moving punch. In this forming process, die 1501 is provided with receiving nest or locator 1502 to hold a blank feed workpiece (not shown). This blank workpiece is deformed by downward axial movement of punch 1503 through the die as shown to form product piece 1504. Cryogenic fluid 1505 is fed to spray feed line and nozzle 1506 to form jet 1507 that impinges on die 1501, thereby cooling the die. Cryogenic fluid may be applied to any location, including more than one location, on the die. In addition to or as an alternative to applying cryogenic fluid to the die, cryogenic fluid may be applied to any location on punch 1503 as illustrated by cryogenic fluid 1508, feed line and nozzle 1509, and jet 1510. Essentially all of the cryogenic fluid, i.e., at least 90% of cryogenic fluid 1505 and jet 1507 (and/or cryogenic fluid applied at other locations on the die and at locations on the punch) may impinge on the die and punch. The use of the cryogenic fluid may cool each of die 1501 and punch 1503 to a respective geometric average temperature that is less than the geometric average temperature of product piece 1504.

Figure 16:
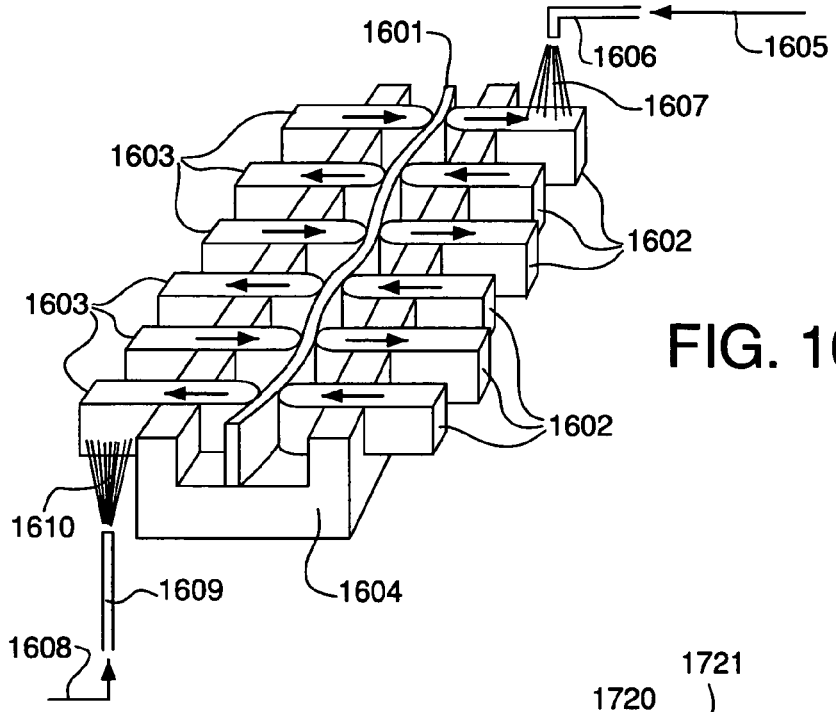
FIG. 16 is a schematic diagram of a moving insert straightening system illustrating the location of cryogenic fluid application according to an embodiment of the invention.

Another embodiment of the invention is illustrated in FIG. 16 for moving insert straightening. Workpiece 1601 is positioned between two rows of movable inserts 1602, and 1603 situated in tool base 1604. The workpiece is subjected to a series of reciprocal strokes by the movable inserts that overbend the workpiece by a preset amount. The amplitude of the movement is progressively reduced during the cycle until it approaches a straight line, at which point a final straight workpiece is produced. The degree of bending movement and the number of bending cycles are adjustable, and varying insert spacing is available to accommodate a wide range of soft or heat-treated components. Some or all of movable inserts 1602 and 1603 may be cooled with a cryogenic fluid. To illustrate this, there is shown cryogenic fluid 1605 fed to spray feed line and nozzle 1606 to form jet 1607 that impinges on one of inserts 1602, thereby cooling the insert. For further illustration, there is shown cryogenic fluid 1608 fed to spray feed line and nozzle 1609 to form jet 1610 that impinges on one of inserts 1603, thereby cooling the insert. Cryogenic fluid may be applied to any location on any insert. Essentially all of the cryogenic fluid, i.e., at least 90% of cryogenic fluids 1605 and 1608 and jets 1607 and 1610 (and cryogenic fluid applied at other locations on the inserts) may impinge on the inserts. The use of the cryogenic fluid may cool each of inserts to a respective geometric average temperature that is less than the geometric average temperature of the final straight workpiece.

Figure 17A:
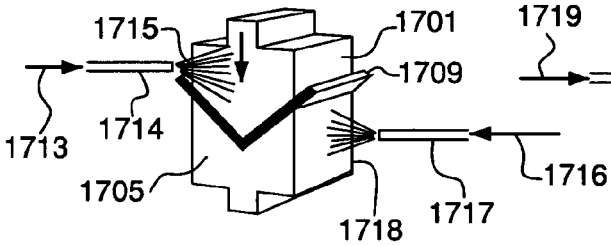
FIGS. 17A, 17B, 17C, and 17D are schematic diagrams of die and punch press bending systems illustrating the locations of cryogenic fluid application according to an embodiment of the invention.

Additional embodiments of the invention are illustrated in FIGS. 17A, 17B, 17C, and 17D for press-brake forming. In this process, punches 1701, 1702, 1703, and 1704, respectively, are forced against dies 1705, 1706, 1707, and 1708, respectively, to produce formed workpieces 1709, 1710, 1711, and 1712, respectively. Cryogenic fluid may be applied to either or both of the punch and the die in each of FIGS. 17A, 17B, 17C, and 17D. FIG. 17A illustrates the application of cryogenic fluid 1713 via spray feed line and nozzle 1714 to form jet 1715 that impinges on punch 1701, thereby cooling the punch. Also illustrated is the application of cryogenic fluid 1716 via spray feed line and nozzle 1717 to form jet 1718 that impinges on die 1705, thereby cooling the die.

Figure 17B:
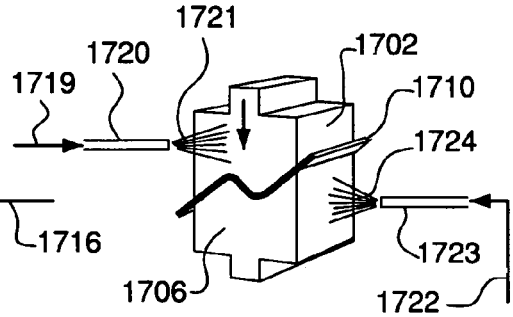

FIG. 17B illustrates the application of cryogenic fluid 1719 via spray feed line and nozzle 1720 to form jet 1721 that impinges on punch 1702, thereby cooling the punch. Also illustrated is the application of cryogenic fluid 1722 via spray feed line and nozzle 1723 to form jet 1724 that impinges on die 1706, thereby cooling the die.

Figure 17C:
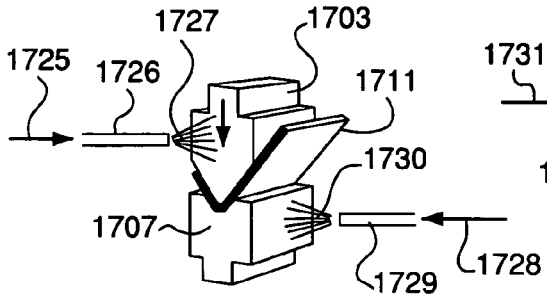

FIG. 17C illustrates the application of cryogenic fluid 1725 via spray feed line and nozzle 1726 to form jet 1727 that impinges on punch 1703, thereby cooling the punch. Also illustrated is the application of cryogenic fluid 1728 via spray feed line and nozzle 1729 to form jet 1730 that impinges on die 1707, thereby cooling the die.

Figure 17D:
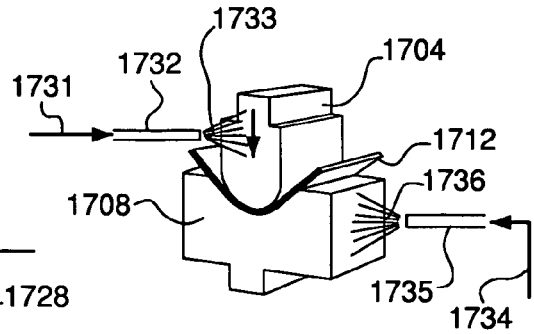

FIG. 17D illustrates the application of cryogenic fluid 1731 via spray feed line and nozzle 1732 to form jet 1733 that impinges on punch 1704, thereby cooling the punch. Also illustrated is the application of cryogenic fluid 1734 via spray feed line and nozzle 1735 to form jet 1736 that impinges on die 1708, thereby cooling the die.

Cryogenic fluid may be applied to any location on any of the punches and dies in FIGS. 17A, 17B, 17C, and 17D. Essentially all of the cryogenic fluid, i.e., at least 90% of each cryogenic fluid and corresponding jet in FIGS. 17A, 17B, 17C, and 17D may impinge on the respective punch or die. The use of the cryogenic fluid may cool each punch and die to a respective geometric average temperature that is less than the geometric average temperature of the final formed workpiece.

Figure 18:
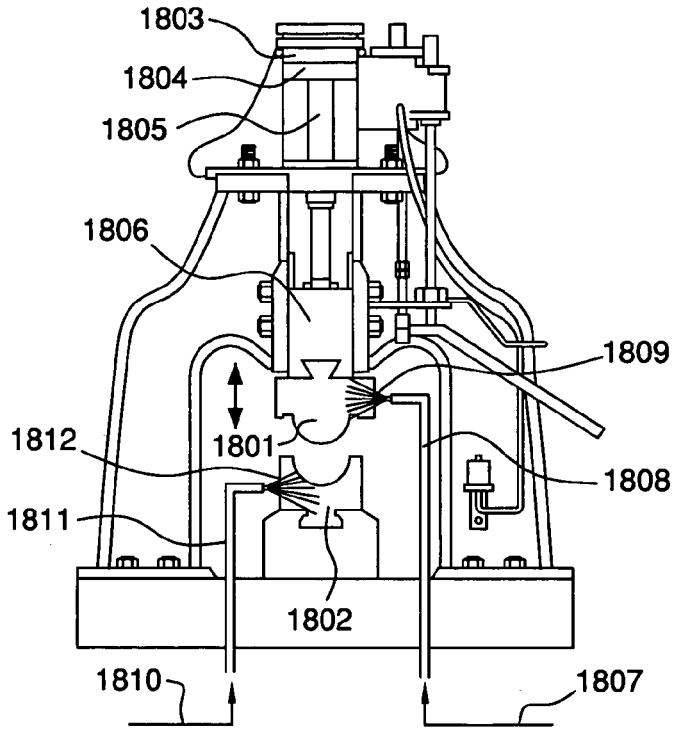
FIG. 18 is a schematic diagram of a hammer forming system illustrating the location of cryogenic fluid application according to an embodiment of the invention.

Another embodiment of the invention is illustrated in FIG. 18 for drop hammer forming. In this process, a workpiece (not shown) is placed between punch 1801 and die 1802, and the punch is lowered to press against the workpiece and the die one or more times, thereby forming the workpiece to yield a final formed article. This power drop hammer may be powered by compressed air in cylinder 1803, which moves piston 1804, connecting rod 1805, and ram 1806 to lower punch 1801. Cryogenic fluid may be applied to either or both of the punch and the die. FIG. 18 illustrates the application of cryogenic fluid 1807 via spray feed line and nozzle 1808 to form jet 1809 that impinges on punch 1801, thereby cooling the punch. Also illustrated is the application of cryogenic fluid 1810 via spray feed line and nozzle 1811 to form jet 1812 that impinges on die 1802, thereby cooling the die. Essentially all of the cryogenic fluid, i.e., at least 90% of each cryogenic fluid and corresponding jet in FIG. 18 may impinge on the respective punch or die. The use of the cryogenic fluid may cool the punch and die to a respective geometric average temperature that is less than the geometric average temperature of the final formed article.

Figure 19:
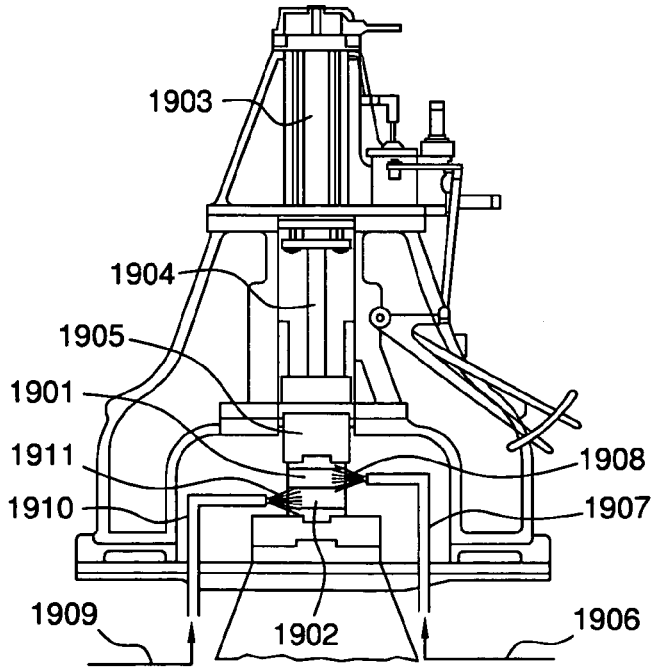
FIG. 19 is a schematic diagram of a die-forging system illustrating the location of cryogenic fluid application according to an embodiment of the invention.

Another embodiment of the invention is illustrated in FIG. 19 for open die forging. In this forming process, a workpiece (not shown) is placed between top die 1901 and bottom die 1902, and the top die is lowered to press against the workpiece and the bottom die one or more times, thereby forming the workpiece to yield a final formed article. This open die forge may be powered by steam in cylinder 1903, which moves piston rod 1904 and ram 1905 to move top die 1901 against bottom die 1902. Cryogenic fluid may be applied to either or both of the punch and the die. FIG. 19 illustrates the application of cryogenic fluid 1906 via spray feed line and nozzle 1907 to form jet 1908 that impinges on top die 1901, thereby cooling the top die. Also illustrated is the application of cryogenic fluid 1909 via spray feed line and nozzle 1910 to form jet 1911 that impinges on lower die 1902, thereby cooling the lower die. Essentially all of the cryogenic fluid, i.e., at least 90% of each cryogenic fluid and corresponding jet in FIG. 19 may impinge on the respective dies. The use of the cryogenic fluid may cool each die to a respective geometric average temperature that is less than the geometric average temperature of the final formed article.

In the illustrations described above with reference to FIGS. 1-19, the workpieces typically may be made of metal or metal alloys. Alternatively, any of the processes may be used with workpieces made of non-metallic materials capable of being plastically deformed, sheared, cut, or otherwise formed without the removal of material as defined above.

The cryogenic fluid may be applied to the desired surface by spraying, jetting, or otherwise directing the fluid to contact and cool the surface of a tool. Any method known in the art may be used, and exemplary methods are described in U.S. Pat. Nos. 6,513,336 B2, 6,564,682 B1, and 6,675,622 B2 and in U.S. Patent Publications 20040237542 A1, 20050211029 A1, 20050016337 A1, 20050011201 A1, and 20040154443 A1, all of which are fully incorporated herein by reference.

Any type of nozzle or open-ended tubing discharging a pressurized cryogenic liquid or multi-phase cryogenic fluid may be used. The thermodynamic condition of the discharged stream (i.e., the stream decompressed at the nozzle exit) typically is such that the discharge results in a partial vaporization of the liquid phase and at least partial disintegration of this liquid into fine, rapidly-moving cryogenic liquid droplets. Typical flow rates of the discharged cryogenic fluid may range from 0.25 to 1.0 lb per min per nozzle at typical supply pressures in the range of 20 to 220 psig. The discharged liquid and vapor typically are saturated at equilibrium at the discharge temperature and pressure; alternatively, the liquid may be slightly subcooled, typically by a few ° C. to about 20° C. below the saturation temperature at the given pressure.

Any appropriate liquid lubricant may be used; the liquid lubricant may be essentially water-free, or alternatively may contain water. A liquid lubricant is liquid at temperatures in the range of about minus 40° C. to about plus 40° C. Oil-water emulsions may be used as lubricants in embodiments of the invention. Any commercially-available cutting oil or cutting fluid may be used to provide the lubricant. Exemplary liquid lubricants for use in embodiments of the present invention are given above.

Solid lubricants (for example, paraffin wax) or semi-solid lubricants (for example, pumpable greases or other flowable materials) may be used instead of (or in addition to) liquid lubricants. A solid lubricant typically is solid at ambient temperatures or below, e.g., below about 40° C. Some solid lubricants may remain solid at temperatures above 40° C. Any appropriate solid or semi-solid lubricant may be used; the lubricant may be essentially water-free, or alternatively may contain water. Solid or semi-solid lubricants typically are applied by pressing, rubbing, smearing, or otherwise directing the solid lubricant to contact the surface of a tool or workpiece and to penetrate and/or fill the microscopic regions formed by the surface asperities. The area of the surface to which the solid or semi-solid lubricant is applied may be cooled in the same manner as described above for liquid lubricants. In most embodiments, the solid or semi-solid lubricant is applied before the area is cooled.

The invention claimed is:

1. A method of forming a workpiece comprising (a) providing a tool for metal forming and a workpiece, wherein the workpiece comprises metal and has an initial shape;

(b) placing the workpiece and the tool in contact, applying force to the tool and/or the workpiece, and moving the tool and/or the workpiece to effect a change in the initial shape of the workpiece by forming wherein the workpiece softens under said force; and (c) providing a jet of cryogenic fluid and impinging essentially all of the jet of cryogenic fluid on an external surface of the tool, wherein essentially no cooling of the workpiece is effected by impingement of said jet of cryogenic fluid, and the geometric average temperature of the tool is less than the geometric average temperature of the workpiece; and the tool is cooled such that it retains hardness and strength; and further wherein said method of forming is selected from the group consisting of contour and profile roll forming, power spinning, roll forging, orbital forging, shoe-type pinch rolling, alligator shearing, guillotine shearing, punch parting, rotary shearing, line shearing, slitting, wire and rod drawing, tube drawing, moving mandrel drawing, punch drawing, moving insert straightening, die and punch press bending, hammer forming, and die forging.

2. The method of claim 1 wherein the workpiece is plastically deformed by the tool.

3. The method of claim 1 wherein the workpiece is separated into two or more pieces by the tool.

4. The method of claim 1 further comprising applying a lubricant to any area on a surface of the tool and/or to any area on a surface of the workpiece.

5. The method of claim 4 wherein the lubricant comprises a powder entrained in the jet of cryogenic fluid.

6. The method of claim 4 wherein the lubricant is a liquid sprayed onto the tool and/or workpiece in combination with impinging essentially all of the jet of cryogenic fluid on a surface of the tool.

7. The method of claim 6 wherein the tool comprises a surface energy less than about 38 milliNewtons per meter (38 mN/m) and/or the workpiece comprises a surface energy less than about 38 milliNewtons per meter (38 mN/in).

8. The method of claim 6 wherein the amount of lubricant applied to the tool and/or the workpiece is less than about 100 milligrams per square foot.

9. The method of claim 4 wherein the lubricant is solid or semi-solid and the lubricant is applied by pressing or smearing onto the tool and/or workpiece.

10. The method of claim 1 wherein the cryogenic fluid is selected from the group consisting of nitrogen, argon, carbon dioxide, and mixtures thereof.

11. A method of forming a workpiece comprising (a) providing a tool for metal forming and a workpiece comprising metal, wherein the workpiece has an initial shape;

(b) placing the workpiece and the tool in contact, applying force to the tool and/or the workpiece, and moving the tool and/or the workpiece to effect a change in the initial shape of the workpiece by forming wherein the workpiece softens under said force; and (c) providing a jet of cryogenic fluid and impinging at least a portion of the jet of cryogenic fluid on an external surface of the tool while impinging essentially none of the jet of cryogenic fluid on the workpiece; wherein essentially no cooling of the workpiece is effected by impingement of said jet of cryogenic fluid, and the geometric average temperature of the tool is less than the geometric average temperature of the workpiece; and the tool is cooled such that it retains hardness and strength; and further wherein said method of forming is selected from the group consisting of contour and profile roll forming, power spinning, roll forging, orbital forging, shoe-type pinch rolling, alligator shearing, guillotine shearing, punch parting, rotary shearing, line shearing, slitting, wire and rod drawing, tube drawing, moving mandrel drawing, punch drawing, moving insert straightening, die and punch press bending, hammer forming, and die forging.

12. The method of claim 11 further comprising (d) terminating contact of the tool and workpiece.

13. A shaped article made by a method comprising (a) providing a tool for metal forming and a workpiece comprising metal, wherein the workpiece has an initial shape;

(b) placing the workpiece and the tool in contact, applying force to the tool and/or the workpiece, and moving the tool and/or the workpiece to effect a change in the initial shape of the workpiece by forming wherein the workpiece softens under said force;

(c) providing a jet of cryogenic fluid and impinging essentially all of the jet of cryogenic fluid on an external surface of the tool wherein said tool retains its hardness and strength, and wherein essentially no cooling of the workpiece is effected by impingement of said jet of cryogenic fluid, and the geometric average temperature of the tool is less than the geometric average temperature of the workpiece; and (d) forming the workpiece into a final shape to provide the shaped article, wherein said method of forming is selected from the group consisting of contour and profile roll forming, power spinning, roll forging, orbital forging, shoe-type pinch rolling, alligator shearing, guillotine shearing, punch parting, rotary shearing, line shearing, slitting, wire and rod drawing, tube drawing, moving mandrel drawing, punch drawing, moving insert straightening, die and punch press bending, hammer forming, and die forging.

14. A shaped article made by a method comprising (a) providing a tool for metal forming and a workpiece comprising metal, wherein the workpiece has an initial shape;

(b) placing the workpiece and the tool in contact, applying force to the tool and/or the workpiece, and moving the tool and/or the workpiece to effect a change in the initial shape of the workpiece by forming wherein the workpiece softens under said force;

(c) providing a jet of cryogenic fluid and impinging at least a portion of the jet of a jet of cryogenic fluid on an external surface of the tool while impinging essentially none of the jet of cryogenic fluid on the workpiece, wherein said tool retains its hardness and strength, and the geometric average temperature of the tool is less than the geometric average temperature of the workpiece; and (d) forming the workpiece into a final shape to provide the shaped article, wherein said method of forming is selected from the group consisting of contour and profile roll forming, power spinning, roll forging, orbital forging, shoe-type pinch rolling, alligator shearing, guillotine shearing, punch parting, rotary shearing, line shearing, slitting, wire and rod drawing, tube drawing, moving mandrel drawing, punch drawing, moving insert straightening, die and punch press bending, hammer forming, and die forging.

15. An apparatus for processing a workpiece comprising (a) a tool for metal forming and a workpiece comprising metal, wherein the workpiece comprises metal and has an initial shape;

(b) means for placing the workpiece and the tool in contact to form an interface, means for applying force to the tool and/or the workpiece, and means for moving the tool and/or the workpiece to effect a change in the initial shape of the workpiece wherein the work material softens under said force; and (c) a cryogenic fluid application system adapted for providing a jet of cryogenic fluid and impinging essentially all of the jet of cryogenic fluid on an external surface of the tool, wherein essentially no cooling of the workpiece is effected by impingement of said jet of cryogenic fluid, and the geometric average temperature of the tool is less than the geometric average temperature of the workpiece; and the tool is cooled such that it retains hardness and strength; said apparatus selected from the group consisting of contour and profile roll forming systems, power spinning systems, roll forging systems, orbital forging systems, shoe-type pinch rolling systems, alligator shearing systems, guillotine shearing systems, punch parting systems, rotary shearing systems, line shearing systems, slitting systems, wire and rod drawing systems, tube drawing systems, moving mandrel drawing systems, punch drawing systems, moving insert straightening systems, die and punch press bending systems, hammer forming systems, and die forging systems.

* * * * *